US006068589A

United States Patent [19]

Neukermans

[11] Patent Number: 6,068,589

[45] Date of Patent: May 30, 2000

[54] BIOCOMPATIBLE FULLY IMPLANTABLE HEARING AID TRANSDUCERS

[76] Inventor: Armand P. Neukermans, 3510 Arbutus Ave., Palo Alto, Calif. 94303

[21] Appl. No.: 08/801,056

[22] Filed: Feb. 14, 1997

Related U.S. Application Data

[60] Provisional application No. 60/011,691, Feb. 15, 1996, and provisional application No. 60/011,882, Feb. 20, 1996.

[51] Int. Cl.[7] ..... H04R 25/00

[52] U.S. Cl. ..... 600/25

[58] Field of Search ..... 600/22; 381/68–69.2, 381/71

[56] References Cited

U.S. PATENT DOCUMENTS

| | | |
|---|---|---|
| 3,227,836 | 1/1966 | Renwick, Sr. . |
| 4,498,461 | 2/1985 | Hakansson . |
| 4,617,913 | 10/1986 | Eddington . |
| 4,729,366 | 3/1988 | Schaefer . |
| 4,817,607 | 4/1989 | Tatge . |
| 4,817,609 | 4/1989 | Perkins et al. . |
| 4,850,962 | 7/1989 | Schaefer . |
| 4,908,509 | 3/1990 | Senturia . |
| 4,943,750 | 7/1990 | Howe et al. . |
| 4,957,478 | 9/1990 | Maniglia . |
| 4,988,333 | 1/1991 | Engebretson et al. . |
| 5,015,224 | 5/1991 | Maniglia . |
| 5,015,225 | 5/1991 | Hough et al. . |
| 5,033,999 | 7/1991 | Mersky . |
| 5,061,282 | 10/1991 | Jacobs . |
| 5,070,535 | 12/1991 | Hochmair et al. . |
| 5,085,628 | 2/1992 | Engebretson et al. . |
| 5,095,904 | 3/1992 | Seligman et al. . |
| 5,176,620 | 1/1993 | Gilman . |
| 5,180,391 | 1/1993 | Beoni . |
| 5,239,588 | 8/1993 | Davis . |
| 5,271,397 | 12/1993 | Seligman et al. . |
| 5,282,858 | 2/1994 | Bisch et al. . |
| 5,306,299 | 4/1994 | Applebaum . |
| 5,344,387 | 9/1994 | Lupin . |
| 5,350,966 | 9/1994 | Culp . |
| 5,531,787 | 7/1996 | Lesinski et al. . |
| 5,722,989 | 3/1998 | Fitch et al. ..... 606/205 |
| 5,772,575 | 6/1998 | Lesinski et al. ..... 600/25 |

FOREIGN PATENT DOCUMENTS

| | | | |
|---|---|---|---|
| 076069A1 | 4/1983 | European Pat. Off. . | |
| 259906A1 | 3/1988 | European Pat. Off. . | |
| 0563767 | 10/1993 | European Pat. Off. . | |
| 9000040 | 1/1990 | WIPO | 623/10 |
| 9007915 | 7/1990 | WIPO | 623/10 |

OTHER PUBLICATIONS

Microfabrication Techniques for Integrated Sensors and Microsystems, K.D. Wise, et al., Science, vol. 254, Nov. 1991, pp. 1335–1341.

Hearing Aids: A Historical and Technical Review, W. F. Carver, Ph.D., Jack Katz, Ph.D., Handbook of Clinical Audiology, 1972, pp. 564–576.

Implantable Hearing Devices—State of the Art, Anthony J. Maniglia, M.D., Otolaryngologic Clinics of North America, vol. 22, No. 1, Feb. 1989, pp. 175–200.

(List continued on next page.)

*Primary Examiner*—Samuel Gilbert

*Attorney, Agent, or Firm*—Donald E. Schreiber

[57] ABSTRACT

An improved fully implantable hearing aid (10) in a first aspect includes at least two microphones (28) to provide improved noise cancellation, and, with an array (132) of microphones (28), improved directivity. In a second aspect, the hearing aid (10) includes an improved microactuator (32') in which deflections of a pair of piezoelectric plates (68) are coupled by liquid (52') to a flexible diaphragm (44') for stimulating fluid (20*a*) within an inner ear (17) of a subject (12). In a third aspect, the improved hearing aid (10) includes a directional booster (200) that the subject (12), having an implanted hearing aid (10), may wear on their head (122) for increasing directivity of perceived sound. A fourth aspect of the present invention is an improved implantable microactuator (32", 32'") that generates a mechanical displacement of a diaphragm (82) or a face (96) in response to an applied electrical signal. A liquid coupling between the piezoelectric transducer (54", 54'") and the diaphragm (82) or face (96) provides a mechanical impedance match for the transducer (54", 54'").

22 Claims, 7 Drawing Sheets

OTHER PUBLICATIONS

Current Status of Electromagnetic Implantable Hearing Aids, Richard L. Goode, M.D., Otolaryngologic Clinics of North America, vol. 22, No. 1, Feb. 1989, pp. 201–209.

"How I Do It"—Otology and Neurotology, Laryngoscope 93: Jun. 1983, pp. 824–825.

Laser in Revision Stapes Surgery, S. George Lesinski, M.D., Janet A. Stein, Head and Neck Surgery, vol. 3, No. 1 (Mar.) 1992, pp. 21–31.

Laser for Otosclerosis—Which One if Any and Why, S. George Lesinski, M.D., Lasers in Surgery and Medicine 10:448–457 (1990).

History of Implantable Hearing Aid Development: Review and Analysis, John M. Epley, edited by I. Kaufman Arenberg, Kugler Publications 1991.

Lasers for Otosclerosis, S. George Lesinski, M.D., The Laryngoscope, Supplement No. 46, Jun. 1989, vol. 99, No. 6, Part 2, pp. 1–24.

Homograft (Allograft) Tympanoplasty Update, S. George Lesinski, M.D., Laryngoscope, vol. 96, No. 11, Nov. 1986.

Homograft Tympanoplasty in Perspective, A Long–Term Clinical–Histologic Study of Formal in–Fixed Tympanic Membranes Used for the Reconstruction of 125 Severely Damaged Middle Ears, S. George Lesinski, M.D., The Laryngoscope, Supp. No. 32—vol. 93, No. 11, Part 2, Nov. 1983, pp. 1–37.

FIG._2
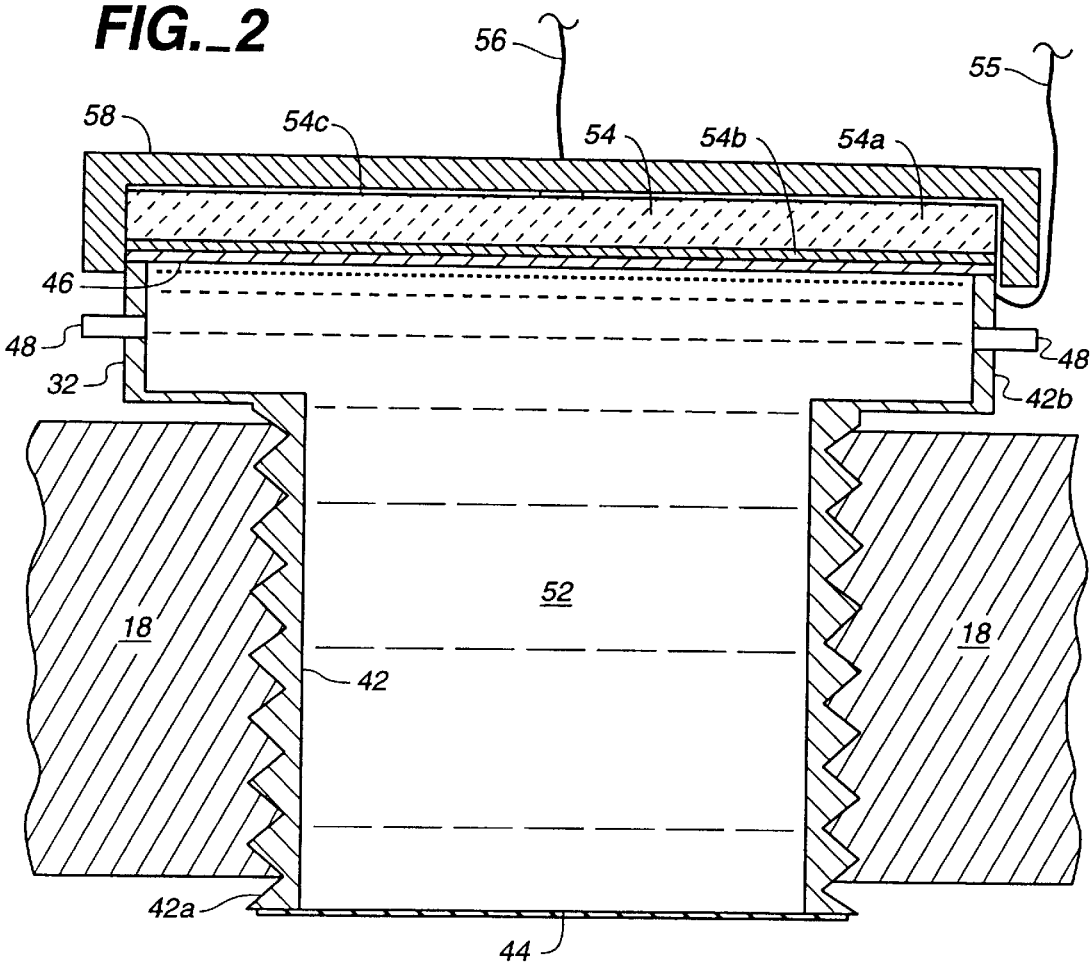
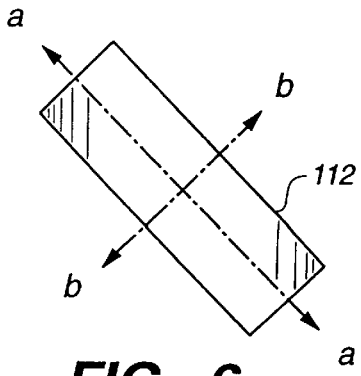
FIG._6

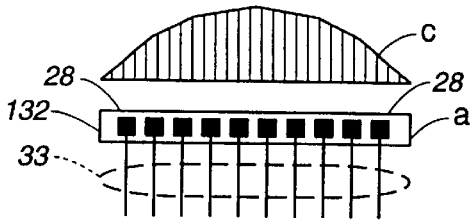
FIG._9
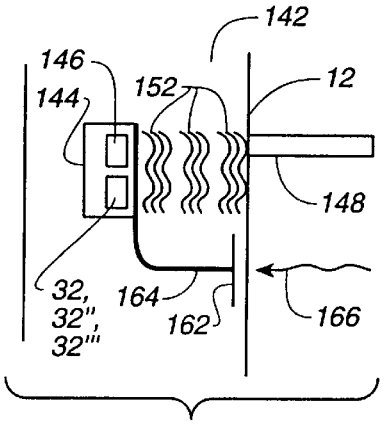
FIG._11
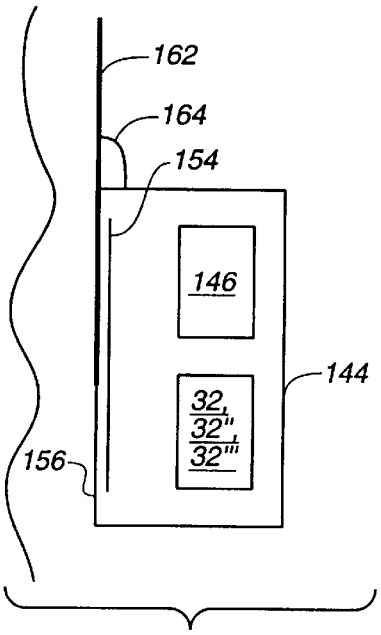
FIG._12
FIG._13A
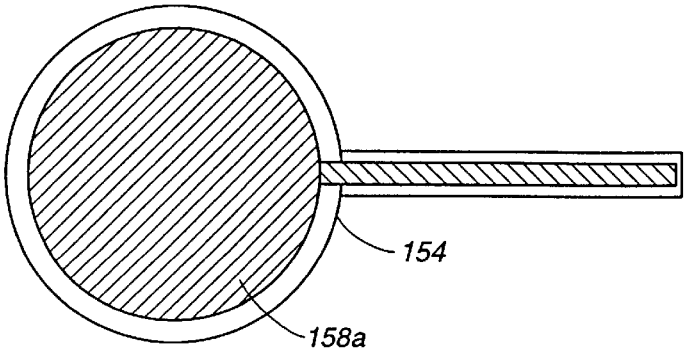
FIG._13B
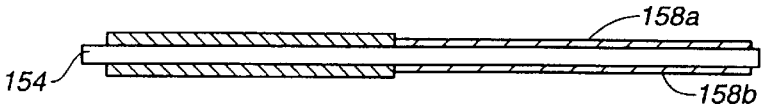

BIOCOMPATIBLE FULLY IMPLANTABLE HEARING AID TRANSDUCERS

CLAIM OF PROVISIONAL APPLICATION RIGHTS

This application claims the benefit of U.S. Provisional patent application Ser. No. 60/011,691 filed on Feb. 15, 1996, and 60/011,882 filed of Feb. 20, 1996.

BACKGROUND OF THE INVENTION

1. Field of the Invention

The present invention relates to the field of implantable biocompatible transducers particularly those useful for a fully implantable hearing aid system, and to effecting such transducers' post-implantation operation.

2. Description of the Prior Art

Presently a need exists for implantable, biocompatible transducers for generating an electrical signal in response to a stimulus occurring either within or outside the body. Correspondingly, there also exists a need for effecting a mechanical action within the body in response to an electrical signal. Such biocompatible transducers are useful for cardiac monitoring, drug delivery, or other bodily functions. Biocompatible, implantable transducers that effect a mechanical action with the body may be used in hearing aids, implantable pumps, valves, or for other types of battery energized biological stimulation. Because supplying power for energizing a transducer's operation after implantation is difficult, high-efficiency transducers that require little electrical power are highly desirable. It is also highly desirable that operation of such microactuators be controlled in as simple and as reliable a manner as possible, and that any non-biocompatible components be thoroughly isolated from the body's tissues and fluids without compromising the microactuator's operation.

Particularly for hearing aids, despite a thirty year development effort, it is well recognized that presently available transducers are less than satisfactory hearing aid. A variety of problems such as distortion in the sound generated by the hearing aid itself, discomfort associated with wearing the hearing aid, and social stigma are all significant factors in user dissatisfaction. Even the very best in-the-canal hearing aids, which by themselves may have low distortion in free space, produce appreciable distortion when in use. This distortion, particularly at high sound levels, arises mainly from positive feedback between the hearing aid's microphone and speaker. The present situation is best illustrated by the fact that if an individual with perfectly normal hearing wears a standard hearing aid, speech recognition becomes impossible for a considerable interval until the hearing aid wearer adapts to the prosthesis. An article by Mead C. Killion entitled "The K-Amp Hearing Aid: An Attempt to Present High Fidelity for Persons With Impaired Hearing," American Journal of Audiology, vol. 2, no. 2, July 1993, describes customizing a hearing aid's performance characteristics to meet the unique requirements of each subject's particular hearing loss.

Generally aging produces a hearing loss which cannot be properly compensated by present hearing aids. In most instances, hearing loss occurs generally at higher frequencies. For that reason many hearing aids therefore boost high frequency gain to compensate for this hearing loss. However, such simple techniques inadequately compensate for high frequency hearing loss. The most frequent complaint of hearing aid wearers is the same as that other people who do not wear hearing aids: namely, the inability to discriminate speech in a noisy environment such as at a social gathering, a party, etc. where the hearing aid assistance can be of significant social importance An inability of improve discrimination between noise and a useful signal, typically speech, is a significant problem that severely limits the usefulness of present hearing aids. In such situations, a hearing impaired individual can very clearly hear the acoustic signals, including the desirable ones, but is unable to discriminate or make sense out of them. Conversely, it is well recognized that a person with good hearing can converse with an other person in a noisy environment.

High frequencies present in consonants contain much speech information. With aging, because of high frequency hearing loss, the ability to catch these high frequency cues decreases, and the efficiency of the noise discrimination diminishes. As a result, to capture an intelligible conversation or any signal in a noisy environment such as a party, the hearing impaired individual typically requires that the conversational sound level be approximately 10 to 15 dB above the surrounding noise level. Conversely, it is well known that an individual with good hearing can converse with an other person in a noisy environment, even though the surrounding sound level may be 10 to 15 dB higher than the speech sound level. Although a normal individual may not capture all the sounds in such a noisy environment, even as little as a 45% recognition rate is adequate for filling in the remaining information. The brain therefore provides extremely agile information discrimination in a noisy environment. Unfortunately most present hearing aids equally amplify both conversational sounds and noise. This inability of present hearing aids to improve discrimination distresses most people, and causes about 70% of hearing impaired individuals to eventually either abandon them, or not to purchase one in the first place.

In essence then, beyond faithful reproduction of sound by a hearing aid, it is desirable to discriminate useful sound from the surrounding noise, although it is not always clear that useful sound can be distinguished, a priori, from noise. However, binaural hearing is known to help in discriminating sound. Other methods, such as digital signal processing that apply complex digital filtering techniques selectively to individual frequency bands may improve speech discrimination. However, such digital signal processing is a very complex problem, and its implementation presently requires computationally powerful digital signal processors. However, presently such processors and their associated components cannot be miniaturized sufficiently for use in an implantable hearing aid. Moreover, such digital signal processors consume an amount of electrical power which exceeds that available for a fully implantable hearing aid system that includes an implanted battery designed for a minimum three to five year battery replacement interval.

Patent Cooperation Treaty ("PCT") patent application Ser. No. PCT/US96/15087 filed Sep. 19, 1996, entitled "Implantable Hearing Aid" ("the PCT Patent Application") describes an implantable hearing aid which uses a very small implantable microactuator that employs a stress-biased lead lanthanum zirconia titanate ("PLZT") transducer material. This PCT Patent Application also discloses a Kynar® microphone which may be physically separated far enough from the implanted microactuator so that no feedback occurs. Embodiments of the microactuator described in this PCT Patent Application disclose how the transducer's deflection or displacement can be magnified, if so desired, by hydraulic amplification. Such microactuators also illustrate how a membrane diaphragm provides good biological isolation for the transducer structure while at the same time fully preserving or actually enhancing transducer performance. This PCT Patent Application also discloses how signals, received by the hearing aid's implantable Kynar microphone, may be used for controlling the hearing aid's operating characteristics. The implantable hearing aid described in the PCT Patent Application, which is extremely compact, sturdy and rugged, provides significant progress towards addressing problems with presently available hearing aids.

SUMMARY OF THE INVENTION

An object of the present invention is to provide a fully implantable hearing aid system that improves a subject's perception of sounds of interest.

Another object of the present invention is to provide a fully implantable hearing aid system that improves the ratio between sounds of interest and background noise.

Another object of the present invention is to provide a fully implantable hearing aid system having a phased array of microphones for receiving sound.

Another object of the present invention is to provide a hearing aid system having improved directivity.

Another object of the present invention is to provide an improved implantable hearing aid microactuator for stimulating fluid within a subject's inner ear.

Another object of the present invention is to provide a general purpose implantable microactuator.

Another object of the present invention is to provide an implantable microactuator having enhanced performance.

Another object of the present invention is to provide an implantable microactuator whose operating characteristics may be easily adapted for a particular application.

Another object of the present invention is to provide an implantable microactuator whose operation may be easily changed from outside a subject's body.

Briefly the present invention includes in one aspect a fully implantable hearing aid system having at least two microphones both of which are adapted for subcutaneous implantation in a subject. Each of the microphones independently generates an electric signal in response to sound waves impinging upon the subject. The hearing aid's signal processing means, also adapted for implantation in the subject, receives both electric signals produced by the microphones and appropriately processes the received electric signal to reduce ambient noise. The signal processing means re-transmits the noise reduced processed electric signal to the hearing aid's implantable microactuator for supplying a driving electrical signal thereto. A transducer included in the microactuator is adapted for mechanically generating vibrations directly within the fluid within the subject's inner ear which the subject perceives as sound.

In a first embodiment of the noise reducing, fully implantable hearing aid system, the microphones are adapted for implantation at separated locations on the subject. One implantation location is chosen for its proximity to sounds of interest, while the other implantation location is chosen for receiving ambient noise. In a second embodiment of the noise reducing, fully implantable hearing aid system one microphone is implanted subcutaneously in the subject's earlobe where impingement of sound of interest on the earlobe may stretch or compress the microphone's transducer. In a third embodiment of the noise reducing, fully implantable hearing aid system individual microphones included in an array of microphones independently respond to sound waves impinging upon the subject. The signal processing means independently receives and processes the signals from each microphone in the array to produce a desired hearing aid sensitivity pattern.

The present invention includes in a second aspect a fully implantable hearing aid system having an improved microactuator that includes a hollow body having an open first end and an open first face that is separated from the first end. A first flexible diaphragm, adapted for deflection outward from and inward toward the microactuator body, seals the body's first end. In one embodiment of the improved microactuator, a second flexible diaphragm seals the body's first face thereby hermetically sealing the body. An incompressible liquid fills the hermetically sealed body. A first plate of a piezoelectric material is mechanically coupled to the second flexible diaphragm. The plate of piezoelectric material receives the driving electrical signal from the hearing aid's signal processing means. Application of the processed electric signal to the first plate as the driving electrical signal directly deflects the second flexible diaphragm, which deflection is coupled by the liquid within the body from the second flexible diaphragm to deflect the first flexible diaphragm for stimulating the subject's inner ear fluid.

In a preferred embodiment of the fully implantable hearing aid system's improved microactuator the microactuator's body further includes an open second face that is also separated from the first end of the body. The second face is also sealed by a third flexible diaphragm thereby maintaining the body's hermetic sealing. A second plate of a piezoelectric material is mechanically coupled to the second flexible diaphragm and also receives the driving electrical signal. Application of the processed electric signal to the first and second plates as the driving electrical signals directly deflects the second and third flexible diaphragms, which deflections are coupled by the liquid within the body from the second and third flexible diaphragms to deflect the first flexible diaphragm for stimulating the subject's inner ear fluid.

The present invention includes in a third aspect a directional booster that a subject, having an implanted hearing aid system, may wear on their head or body for increasing directivity of sound perceived by the subject. By increasing the directivity of sound perceived by the subject, the subject may effectively improve the signal to noise ration of sound of interest.

The present invention includes in a fourth aspect an implantable microactuator that generates a mechanical displacement in response to an applied electrical signal. The microactuator includes a hollow body having an open first end, and an open second end that is separated from the first end. A first flexible diaphragm, adapted for deflection outward from and inward toward the body, seals the first end of the body. A second flexible diaphragm seals the second end thereby hermetically seals the body, and an incompressible liquid fills the hermetically sealed body. A first plate of a piezoelectric material is mechanically coupled to the second flexible diaphragm and receives the applied electric signal. Application of the electric signal to the first plate directly displaces the second flexible diaphragm. Displacement of the second flexible diaphragm is coupled by the liquid within the body from the second flexible diaphragm to the first flexible diaphragm. In an embodiment of this improved microactuator, corrugations formed in the first flexible diaphragm, or that encircle the body intermediate the second flexible diaphragm and the first flexible diaphragm, permit millimeter displacements of the first flexible diaphragm in response to the applied electric signal.

These and other features, objects and advantages will be understood or apparent to those of ordinary skill in the art from the following detailed description of the preferred embodiment as illustrated in the various drawing figures.

BRIEF DESCRIPTION OF THE DRAWINGS

FIG. 2 is a cross-sectional elevational view depicting a microactuator included in the fully implantable hearing aid system depicted in FIG. 1 that is implanted in the promontory of the inner ear, that has a transducer located in the middle ear cavity, and that employs hydraulic coupling between the transducer and a flexible diaphragm for stimulating fluid located within the inner ear of a subject;

FIG. 6 is a plan view of a PVDF (Kynar) sheet illustrating sensitivity axes of the PVDF film;

FIG. 9 is an intensity diagram depicting directional sensitivity of a microphone array;

FIG. 11 is a cross-sectional plan view schematically illustrating sonic or ultrasonic control of an implanted microactuator that is hermetically enclosed in a biologically inert housing;

FIG. 12 is an enlarged cross-sectional plan view depicting a PVDF sheet located within the biologically inert microactuator housing depicted in FIG. 11;

FIG. 13A is a plan view depicting a shape for the PVDF sheet suitable for use in a microactuator housing having a circularly-shaped wall;

FIG. 13B is an elevational view of the circularly-shaped microactuator depicted in FIG. 13A;

DETAILED DESCRIPTION OF THE PREFERRED EMBODIMENT

I Fully Implantable Hearing Aid System

Figure 1:
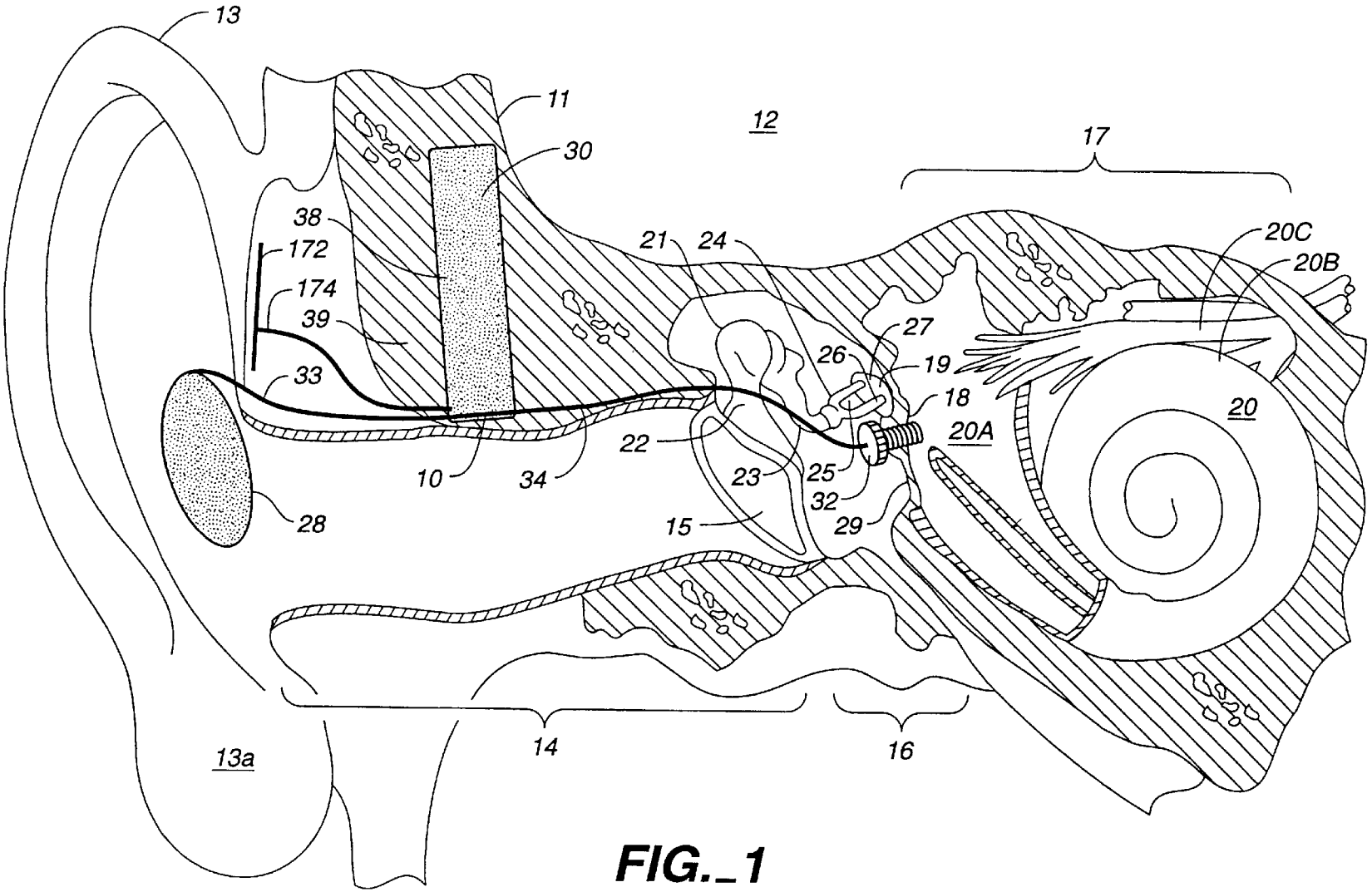
FIG. 1 is a schematic coronal, partial sectional view through a human temporal bone illustrating the external, middle and inner ears, and showing the relative positions of the components of a fully implantable hearing aid system disclosed in the PCT Patent Application.

FIG. 1 illustrates relative locations of components of a fully implantable hearing aid 10 after implantation in a temporal bone 11 of a human subject 12. FIG. 1 also depicts an external ear 13 located at one end of an external auditory canal 14, commonly identified as the ear canal. An opposite end of the external auditory canal 14 terminates at an ear drum 15. The ear drum 15 mechanically vibrates in response to sound waves that travel through the external auditory canal 14. The ear drum 15 serves as an anatomic barrier between the external auditory canal 14 and a middle ear cavity 16. The ear drum 15 amplifies sound waves by collecting them in a relatively large area and transmitting them to a much smaller area of an oval-shaped window 19. An inner ear 17 is located in the medial aspects of the temporal bone 11. The inner ear 17 is comprised of otic capsule bone containing the semicircular canals for balance and a cochlea 20 for hearing. A relatively large bone, referred to as the promontory 18, projects from the otic capsule bone inferior to the oval window 19 which overlies a basal coil of the cochlea 20. A round window 29 is located on the opposite side of the promontory 18 from the oval window 19, and overlies a basal end of the scala tympani.

Three mobile bones (malleus, incus and stapes), referred to as an ossicular chain 21, span the middle ear cavity 16 to connect the ear drum 15 with the inner ear 17 at the oval window 19. The ossicular chain 21 conveys mechanical vibrations of the ear drum 15 to the inner ear 17, mechanically de-amplifying the motion by a factor of 2.2 at 1000 Hz. Vibrations of a stapes footplate 27 in the oval window 19 cause vibrations in perilymph fluid 20*a* contained in scala vestibuli of the cochlea 20. These pressure wave "vibrations" travel through the perilymph fluid 20*a* and endolymph fluid of the cochlea 20 to produce a traveling wave of the basilar membrane. Displacement of the basilar membrane bends "cilia" of the receptor cells 20*b*. The shearing effect of the cilia on the receptor cells 20*b* causes depolarization of the receptor cells 20*b*. Depolarization of the receptor cells 20*b* causes auditory signals to travel in a highly organized manner along auditory nerve fibers 20*c*, through the brainstem to eventually signal a temporal lobe of a brain of the subject 12 to perceive the vibrations as "sound."

The ossicular chain 21 is composed of a malleus 22, an incus 23, and a stapes 24. The stapes 24 is shaped like a "stirrup" with arches 25 and 26 and a stapes footplate 27 which covers the oval window 19. The mobile stapes 24 is supported in the oval window 19 by an annular ligament which attaches the stapes footplate 27 to the solid otic capsule margins of the oval window 19.

FIG. 1 also illustrates the three major components of the hearing aid 10, a microphone 28, a signal-processing amplifier 30 which includes a battery not separately depicted in FIG. 1, and microactuator 32. Miniature cables or flexible printed circuits 33 and 34 respectively interconnect the signal-processing amplifier 30 with the microactuator 32, and with the microphone 28. The microphone 28 is mounted below the skin in the auricle, or alternatively in the postauricular area of the external ear 13 including the lobule 13*a*, i.e. the earlobe.

The signal-processing amplifier 30 is implanted subcutaneously behind the external ear 13 within a depression 38 surgically sculpted in a mastoid cortical bone 39 of the subject 12. The signal-processing amplifier 30 receives a signal from the microphone 28 via the miniature cable 33, amplifies and conditions that signal, and then re-transmits the processed signal to the microactuator 32 via the miniature cable 34 implanted below the skin in the external auditory canal 14. The signal-processing amplifier 30 processes the signal received from the microphone 28 to optimally match characteristics of the processed signal to the microactuator 32 to obtain the desired auditory response. The signal-processing amplifier 30 may perform signal processing using either digital or analog signal processing, and may employ both nonlinear and highly complex signal processing.

The microactuator 32 transduces the electrical signal received from the signal-processing amplifier 30 into vibrations that either directly or indirectly mechanically vibrate the perilymph fluid 20*a* in the inner ear 17. As described previously, vibrations in the perilymph fluid 20*a* actuate the receptor cells 20*b* to stimulate the auditory nerve fibers 20*c* which signal the brain of the subject 12 to perceive the mechanical vibrations as sound.

FIG. 1 depicts the relative position of the microphone 28, the signal-processing amplifier 30 and the microactuator 32 with respect to the external ear 13. Even though the signal-processing amplifier 30 is implanted subcutaneously, the subject 12 may control the operation of the hearing aid 10 using techniques analogous to those presently employed for controlling the operation of miniaturized external hearing aids. Both the microphone 28 and the microactuator 32 are so minuscule that their implantation requires little or no destruction of the tissue of the subject 12. Of equal importance, the microphone 28 and the signal-processing amplifier 30 do not interfere with the normal conduction of sound through the ear, and thus will not impair hearing when the hearing aid 10 is turned off or not functioning.

II Improved Microactuator 32

FIG. 2 depicts an embodiment of the microactuator 32 described in the PCT Patent Application PCT/US96/15087 that is hereby incorporated by reference. The PCT Patent Application claims priority from U.S. patent application Ser. No. 08/532,398 filed Sep. 22, 1995, which issued on Jun. 30, 1998, as U.S. Pat. No. 5,772,575 ("the '575 patent"). The '575 patent is hereby incorporated by reference. The microactuator 32 illustrated in FIG. 2 includes a threaded, metallic tube 42 that screws into a fenestration formed through the promontory 18. The fenestration can be made by a mechanical surgical drill, or by present surgical laser techniques. Due to the physical configuration of the cochlea 20 and of the promontory 18, the portion of the tube 42 threaded into the fenestration has a diameter of approximately 1.4 mm. The tube 42 may be made out of stainless steel or any other biocompatible metal. A smaller end 42*a* of the tube 42 is sealed by a metal diaphragm 44, and a second metal diaphragm 46 seals a larger end 42*b* of the tube 42. Located in the middle ear cavity 16, the larger end 42*b* of the tube 42 can be as large as 2.6 mm. The smaller end 42*a* of the tube 42 together with the diaphragm 44 is situated in the inner ear 17 in contact with the perilymph fluid 20*a*.

Small capillaries 48 pierce the larger end 42*b* of the tube 42 to permit filling the tube 42 between the diaphragms 44 and 46 completely with an incompressible liquid 52 such as silicone oil, saline fluid, etc. The liquid 52 must be degassed and free of bubbles so volumetric displacements of the diaphragm 46 are faithfully transmitted to the diaphragm 44. This is done by evacuating the tube 42 and backfilling it through the small capillaries 48. The capillaries 48, if made of stainless steel, titanium or other suitable biocompatible material, may be sealed with pulsed laser welding which produces an instantaneous seal without bubbles. Alternatively, small copper capillaries 48 may be used for backfilling and then pinched off.

A stress-biased PLZT disk-shaped transducer 54 is conductively attached to the diaphragm 46 and to the larger end 42*b* of the tube 42. Alternatively, the transducer 54 may be made small enough to rest entirely on diaphragm 46. A conductive cermet layer 54*b* of the transducer 54 is juxtaposed with the metal diaphragm 46. The tube 42, the diaphragm 46 and conductive cermet layer 54*b* are preferably grounded through an electrical lead 55 included in the miniature cable 34. A PLZT layer 54*a* of the transducer 54 is coated with a conductive layer 54*c* of gold or any other suitable biocompatible material. An electrical lead 56, included in the miniature cable 34, is attached to the conductive layer 54*c* either through wire bonding or with conductive epoxy. A thin conformal layer 58 of a coating material covers the larger end 42*b* and the transducer 54 to encapsulate the transducer 54.

Application of a voltage to the transducer 54, which in FIG. 2 sits over the fluid filled tube 42, displaces the diaphragm 44 a distance that is four (4) times larger than displacement of the diaphragm 46 because the area of the diaphragm 46 is 4 times larger than the area of the diaphragm 44. In fact, because the volume displacement of transducer 54 increases as the fourth power of transducer diameter, for a pre-established voltage applied across the transducer 54 the volume of displaced liquid 52, which is the significant characteristic for a hearing aid, is sixteen (16) times larger, than if a transducer of the same diameter as diaphragm 44 were placed in the location of diaphragm 44. As described in the PCT Patent Application, the microactuator 32 may actually include two disk-shaped transducers 54 for increasing deflection of the diaphragm 44.

The arrangement of the diaphragms 44 and 46 depicted FIG. 2 provides a mechanical impedance match for the transducer 54. The displacement amplification provided by the liquid 52 acts as the impedance transformer, and does so all the way into the audio range frequency. Consequently, the microactuator 32 depicted in FIG. 1 matches the characteristics of the transducer 54 to the characteristics desired for the hearing aid 10. The impedance match provided here is a large deflection of the diaphragm 44 desired in the inner ear 17, constrained by a limited driving voltage applied across the transducer 54, and a limited fenestration diameter provided by the promontory 18 and the cochlea 20. Other mechanical impedance matching devices (such as levers) may be used, but the fluid-filled microactuator 32 provides for extremely smooth and powerful motion.

Note that larger end 42*b* of the tube 42 from the PCT Patent Application depicted in FIG. 1 located in the middle ear cavity 16 need not be limited to a rounded shape. Rather, as described in greater detail below the shape of the larger end 42*b* may preferably be formed so it confoms much better anatomically to the shape of the inner ear cavity (e.g. the larger end 42*b* is elongated) which also permits better anchoring of the microactuator 32 to promontory 18. Such a shape for the larger end 42*b* permits enlarging the surface area of the transducer 54 which increases its deflection and displacement. For an implantable hearing aid microactuator 32 it is desirable to produce a large displacement of the diaphragm 44 for the smallest possible voltage applied across the transducer 54. The PCT Patent Application describes various embodiments of the microactuator 32 directed toward achieving such a result.

Figure 3B:
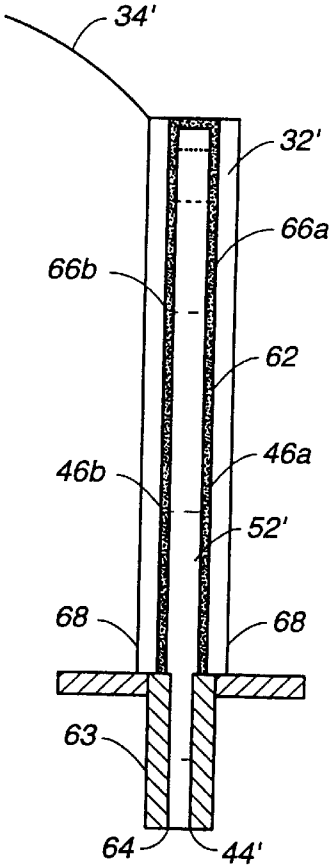
FIG. 3B is a cross-sectional elevational view of the microactuator taken along the line 3B—3B in FIG. 3A.
Figure 3A:
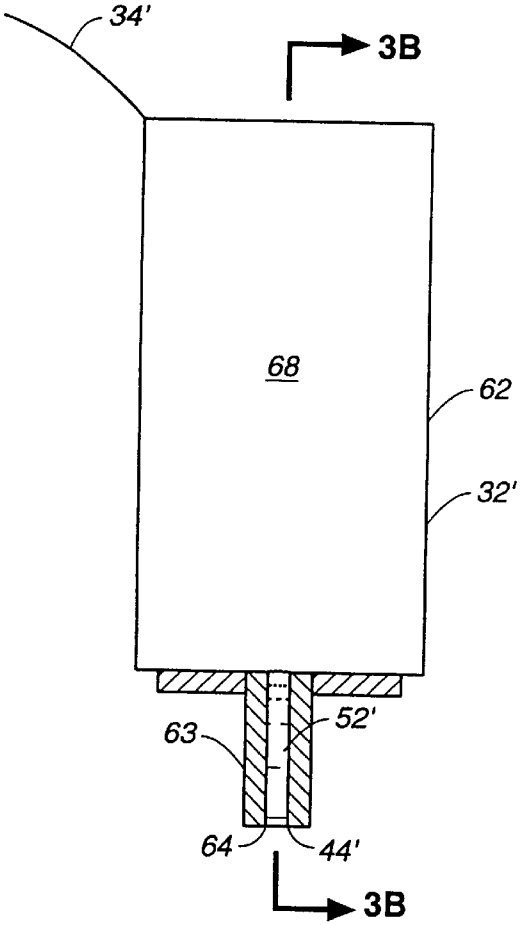
FIG. 3A is a partially sectioned elevational view of an alternative embodiment fully implantable hearing aid system microactuator.

FIGS. 3A and 3B depict an alternative embodiment of the microactuator 32 which provides a large displacement of the diaphragm 44 in response to application of a smaller voltage across the transducer. Those elements depicted in FIGS. 3A and 3B that are common to the microactuator 32 depicted in FIG. 2 carry the same reference numeral distinguished by a prime ("') designation. The microactuator 32' includes a hollow body 62 from one end of which projects a cylindrically-shaped, flanged nozzle 63. The flanged nozzle 63, which is adapted for insertion into a fenestration formed through the promontory 18, has an open first end 64. The first end 64 is sealed by the flexible diaphragm 44' that may be deflected outward from and inward toward the body 62. The body 62 has two open faces 66*a* and 66*b* that are separated from the first end 64. Each of the faces 66*a* and 66*b* are respectively sealed by flexible diaphragms 46*a* and 46*b* which, in combination with the diaphragm 44', hermetically seal the body 62. In most instances, each of the diaphragms 46*a* and 46*b* are oriented in a direction that is not parallel to the diaphragm 44'. As depicted in FIGS. 3A and 3B, the diaphragms 46*a* and 46*b* respectively have cross-sectional areas that are larger than a cross-sectional area of the diaphragm 44'. While the preceding description of the body 62 identifies various individual parts thereof, the body 62 may, in fact, be provided by a one-piece can formed from a material suitable for the diaphragms 46*a* and 46*b*.

The hermetically sealed hollow body 62 is filled with the incompressible liquid 52'. Respectively secured to each of the diaphragms 46*a* and 46*b* are plates 68 of piezoelectric material which face each other. Anatomical considerations permit the plates 68 to extend a considerable distance into the middle ear cavity 16, and also permit shapes for the body 62 and the plates 68 that differ from those depicted in FIGS. 3A and 3B. The base of the body 62 adjacent to the flanged nozzle 63 can be very narrow and the length of the body 62 and plates 68 extending outward from the flanged nozzle 63 enlarged so that the volume of the liquid 52' displaced by the plates 68 becomes quite large. In this way the plates 68 can be shaped, twisted and tilted to fit the middle ear cavity 16, and are not restricted to the space locally available at the implantation site.

Each of the plates 68 are electrically connected to the miniature cable 34' to expand or contract in opposite direction toward or away from each other in response to the same applied voltage. This driving motion of the plates 68 applied to the diaphragms 46*a* and 46*b* forces the liquid 52 toward or away from the diaphragm 44' that is located in the inner ear 17 of the subject 12. Similar to the microactuator 32 depicted in FIG. 2, application of an electric signal from the signal-processing amplifier 30 to the plates 68 directly deflects the diaphragms 46*a* and 46*b*. Deflection of the diaphragms 46*a* and 46*b* is coupled by the liquid 52' to deflect the diaphragm 44'. While the microactuator 32' preferably employs a pair of plates 68, a microactuator 32' in accordance with the present invention may have only a single plate 68, or each plate 68 of the pair may have a different shape and/or size.

While the illustration of FIGS. 3A and 3B depicts the diaphragms 46*a* and 46*b* as being oriented perpendicular to the diaphragm 44' with the diaphragms 46*a* and 46*b* parallel to each other, other orientations of the diaphragms 46*a* and 46*b* with the respect to the diaphragm 44' are within the scope of the invention. Accordingly, the diaphragms 46*a* and 46*b* can be oriented at a skewed angle with respect to the flanged nozzle 63 and diaphragm 44' to prevent the plates 68 from interfering with the ossicular chain 21 or other structures. The flanged nozzle 63 provides good anchoring to the promontory 18 without requiring extra room which would otherwise reduce space available for the plates 68.

Note that the microactuator 32' may be held in place with an array of stainless or titanium pins and/or barbs projecting around the periphery of the flanged nozzle 63 as described in the PCT Patent Application. In that way, the microactuator 32' need not be turned or twisted during implantation into the fenestration through the promontory 18. Alternatively, the microactuator 32' may be secured with a small, memory alloy expanding stent such as those used to hold arteries open following cardiac surgery.

Figure 4:
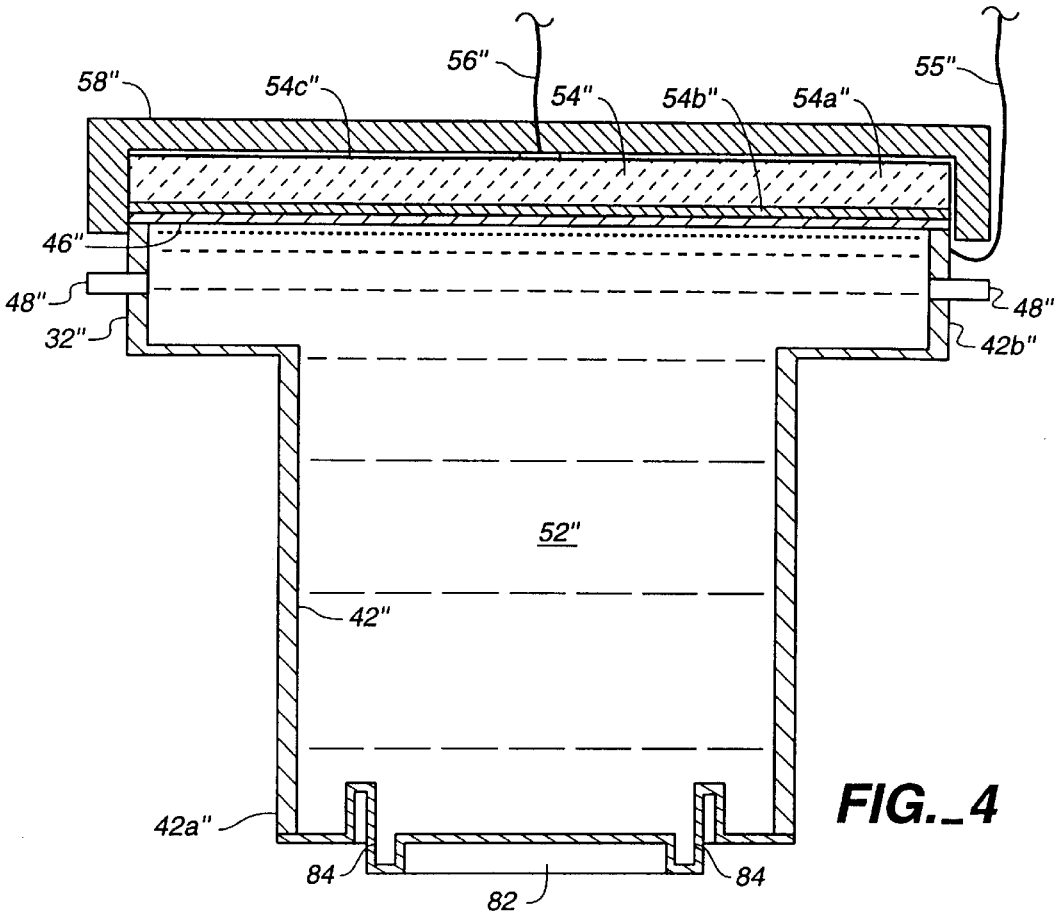
FIG. 4 is a cross-sectional elevational view depicting an alternative embodiment implantable microactuator having a corrugated flexible diaphragm that permits a greater diaphragm displacement.

In the fully implantable hearing aid system application described above, deflections of the diaphragm 44 or 44' are very small (only on the order of a micron), and the driving voltage applied across the transducer 54 or the plates 68 is very low. Consequently, in the fully implantable hearing aid system a flat diaphragm 44 or 44' can be used. However, other applications for the microactuator 32, such as in implantable pumps, valves, or for other types of battery energized biological stimulation, may require a greater displacement for the diaphragm 44 or 44', a larger disk-shaped transducer 54, and/or a higher driving voltage. As illustrated in FIG. 4, for such alternative applications of the microactuator 32, the flat diaphragm 44 or 44' depicted in FIGS. 2, 3A and 3B may be replaced by a bellows diaphragm 82 having circularly-shaped corrugations 84. Those elements depicted in FIG. 4 that are common to the microactuator 32 depicted in FIG. 2 carry the same reference numeral distinguished by a double prime ("") designation. The corrugated bellows diaphragm 82 can provide much larger displacements as desired. The bellows diaphragm 82 may be much thicker than the diaphragm 44 or 44' because the corrugations 84 increase the flexibility of the bellows diaphragm 82. The ratio of the area of the transducer 54 to the actual area of the bellows diaphragm 82 can be much larger than four (4) if desired, and hence quite large displacements of the bellows diaphragm 82 become possible. For example for a transducer 54 that has an area of one-quarter inch, that is 200 microns thick, and that receives a 200 volt ("V") driving signal, and for a 2 mm diameter bellows diaphragm 82, the displacement of the bellows diaphragm 82 may approach 1.0 mm. Such high driving signal voltages can be readily generated from battery voltages using a flyback circuit, since the transducer 54 requires virtually no electrical power for its operation.

Figure 5:
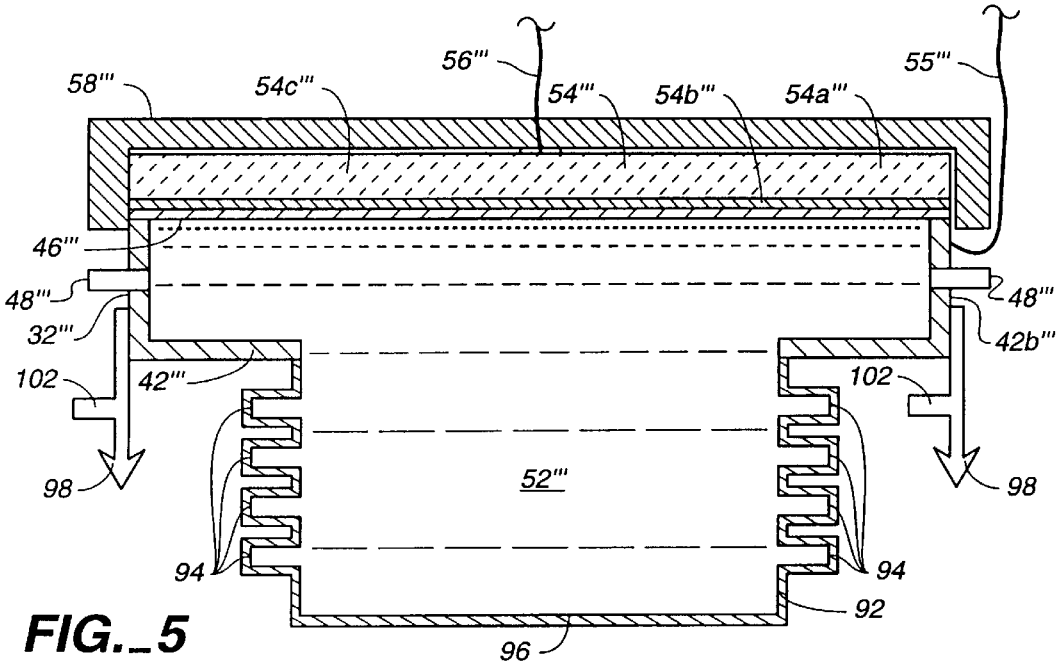
FIG. 5 is a cross-sectional elevational view depicting an alternative embodiment implantable microactuator having a flexible corrugated tube that permits a greater diaphragm displacement.

FIG. 5 depicts yet another alternative embodiment microactuator 32 in which a portion of the tube 42 is replaced by a bellows 92 that includes encircling corrugations 94. Those elements depicted in FIG. 4 that are common to the microactuator 32 depicted in FIG. 2 carry the same reference numeral distinguished by a triple prime ("""") designation. The corrugations 94, which upon implantation into the subject 12 should not be anchored to permit free movement of a moving surface 96, provide large displacements of the surface 96.

The microactuator 32" or 32'" are suitable for inclusion in a fully implantable hearing aid system, such as that depicted in FIG. 1, in which the microactuator 32 implanted into a fenestration formed through the promontory 18 is replaced by the microactuator 32" or 32'" depicted respectively in FIGS. 4 and 5 with the microactuator 32" or 32'" being pressed gently into contact with the round window 29 of the inner ear 17. As described above, the liquid 52" or 52'" provides an impedance match for the disk-shaped transducer 54" or 54'" allowing the large force produced by the transducer 54" or 54'" to be transformed in a larger displacement of the bellows diaphragm 82 or the surface 96. If the ratios of the areas of the transducer 54" or 54'" and the bellows diaphragm 82 or the surface 96 is tenfold, the displacement is enhanced tenfold, and yet the microactuator 32" or 32'" may still apply a force on the order of several grams to deflect the round window 29. For such an application of the microactuator 32" or 32'", as described in the PCT Patent Application micromachined barbs 98 having a stop 102 may encircle the tube 42 for anchoring the microactuator 32" or 32'" within the middle ear cavity 16.

While the configurations of the microactuator 32, 32', 32" and 32'" described thus far respectively increase the deflection or displacement of the diaphragm 44, 44', bellows diaphragm 82 and surface 96 while reducing the force produced by the transducer 54, 54', 54" and 54'", in principle the area of the transducer 54, 54', 54" or 54'" may be smaller than the area of the diaphragm 44, 44', bellows diaphragm 82 or surface 96 thereby producing a larger force but a reduced deflection or displacement of the diaphragm 44, 44', bellows diaphragm 82 or surface 96.

The PCT Patent Application describes the disk-shaped transducer 54 as being preferably fabricated from a stress-biased PLZT material manufactured by Aura Ceramics and sold under the "Rainbow" product designation. Alternatively, differential thermal expansion also permits producing a stress-biased piezoelectric material. That is, a disk of PZT or PLZT ceramic material may be coated at high temperature with a metal foil that is approximately one-third (⅓) the thickness of the ceramic material. This metal coated, piezoelectric ceramic material structure then becomes stress-biased when cooled to room temperature. Metals suitable for coating PZT or PLZT ceramic material include titanium, nickel, titanium-nickel alloys, stainless steel, brass, platinum, gold, silver, etc.

Conventional PZT unimorph or bimorph structures may also be used. The best of such conventional piezoelectric ceramic materials for the transducer 54, 54', 54" or 54'", or for the plates 68 appear to be those in the class called Navy type VI. Such materials include the PTZ5H and C3900 materials manufactured by Aura Ceramics, and in particular the 3203, 3199 or 3211 manufactured by Motorola, Inc. Suitable piezoelectric ceramic materials such as those listed above all exhibit high values of the $d_{31}$ material parameter, and can be lapped to an appropriate thickness such as 75 microns. Such conventional piezoelectric materials are particularly suitable for use in the hearing aid microactuator 32' depicted in FIGS. 3A and 3B.

III Improved Microphone 28

As described in the PCT Patent Application, the preferred embodiment of the microphone 28 illustrated in FIG. 1 consists of a very thin sheet of polyvinylidenefluoride ("PVDF") having an area of approximately 0.5 to 2.0 square centimeter ("$cm^2$") that has bio-compatible metallic electrodes coated onto its surface. As illustrated in FIG. 1, the microphone 28 may be implanted into the lobule 13*a* of the external ear 13. PVDF material suitable for the microphone 28 is identified commercially by a trademark KYNAR that is registered to AMPS Corporation.

As illustrated in FIG. 6, during fabrication a sheet 112 of Kynar is stretched and polarized along an axis (a—a) to produce a permanent dipole in the material. After the permanent dipole has been established, stretching of the sheet 112, for example due to acoustic vibration of the supporting body, produces electric charges on the surface of the sheet 112. Stretching or compressing the Kynar sheet 112 along the axis (a—a) produces large output signals. Conversely, stretching or compressing the Kynar sheet 112 along an axis (b—b), that is perpendicular to the axis (a—a), produces signals which are only one-tenth (1/10) of those produced by stretching along the axis (a—a). As described in greater detail below, these properties of the Kynar sheet 112 may be used advantageously to improve directivity of the microphone 28.

Significant advantages of the Kynar microphone 28 are biocompatibility, extreme thinness, ease of implantation, ruggedness to external pressures or blows, and acoustic impedance matching to tissues of the body. Because the acoustic impedance of Kynar closely matches that of body tissue, virtually no acoustic loss arises from implanting the microphone 28 in the body. Therefore, the Kynar microphone 28 has virtually the same sensitivity when located outside of the body or when implanted subcutaneously.

There are, in principle, at least three methods which may be used to improve the signal to noise ratio of the hearing aid 10 over that of the unprocessed signal.

1. Noise cancellation by using discrete microphones 28 at two (2) locations, both of which microphones 28 are expected to receive about the same ambient noise, but one of which receives a larger signal of interest. Subtraction of the signals from two such microphones 28 improves the signal to noise ratio.
2. Noise cancellation based on the direction of the incoming sound. While method no. 1 above also involves the direction from which sound arrives, this second method uses properties of the Kynar microphone 28 to further improve the signal to noise ratio.
3. Use of an acoustic array in conjunction with signal processing to provide enhanced microphone directivity by splitting a strip of Kynar up into a series of individual microphones 28. Orienting the maximum sensitivity of the array of microphones 28 toward the source of sound enhances signal strength selectively.

These three methods will be discussed one after the other below.

Figure 7:
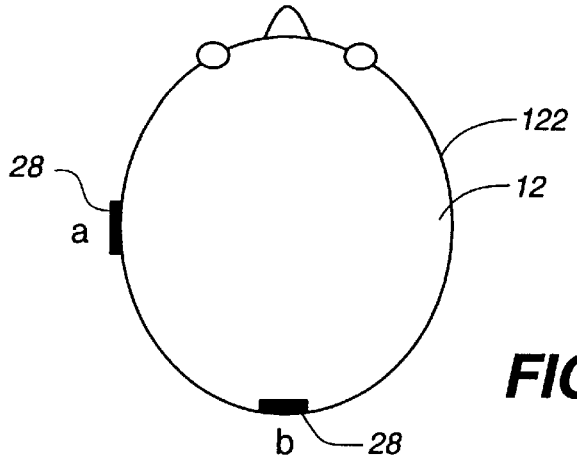
FIG. 7 is a plan view illustrating implantation of a pair of microphones on a subject's head to provide noise cancellation.

FIG. 7 is a plan view of a head 122 of the subject 12 into which a hearing aid system has been implanted. The first microphone 28 described in the PCT Patent Application is implanted in the lobule 13*a* of the external ear 13 at a location (a) in FIG. 7. Because the Kynar microphone 28 is thin and unobtrusive, as illustrated in FIG. 7, a second microphone 28 (or more if desired) may be implanted at a different location (b) on the head 122 of the subject 12. The second microphone 28 at location (b) serves as a general reference point for background noise. At the location (b), the second microphone 28 is less likely to be exposed to sounds of interest, or at least the intensity of the sound of interest is less at the location (b) than at the location (a) of the first microphone 28. The second microphone 28 at location (b) therefore preferentially picks up background noise in the environment, which often is more omnidirectional, having, in most instances, reverberated from a number of surfaces.

Subtracting in the signal-processing amplifier 30 the signal from the second microphone 28 at location (b) from the signal from the first microphone 28 at location (a) enhances the sound of interest. Because the Kynar microphone 28 is thin and small, both microphones 28 can be simply slipped under the skin making implantation of this noise cancellation technique possible without undue discomfort to the subject 12.

Figure 8B:
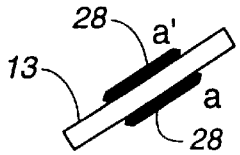
FIG. 8B in an enlarged plan view illustrating implantation of the microphone on different sides of the subject's earlobe.
Figure 8A:
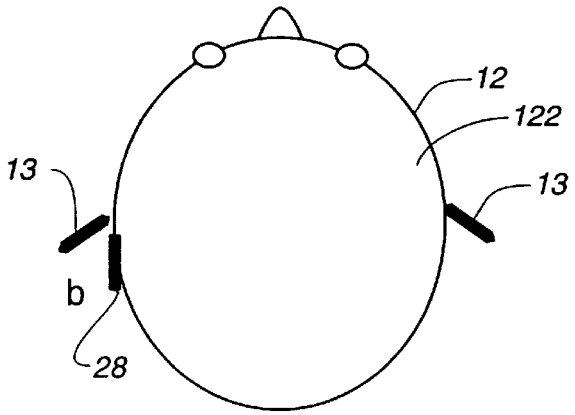
FIG. 8A is a plan view illustrating implantation of a pair of microphones on a subject's head to provide noise cancellation based on the direction from which sound arrives at an earlobe.

FIG. 8A illustrates a second way of implementing noise cancellation which depicts the lobule 13*a* of the external ear 13 projecting from the head 122 of the subject 12. FIG. 8A depicts the lobule 13*a* of the external ear 13 as a plate sticking out from the head 122. Similar to the first technique for noise cancellation, the first microphone 28 is implanted either at location (a) or (a') depicted in FIG. 8B with the second microphone 28 being implanted nearby at a location (b) on the head 122 of the subject 12. The lobule 13*a* of the external ear 13 responds to impingement of acoustic waves by bending ever so slightly. As described above, stretching or compression of the Kynar microphone 28 due to bending of the lobule 13*a* produces an electrical output signal from the microphone 28. Moreover, if the sound wave arrives from in front of the head 122 the sound pressure bends the ear in one direction. If the sound arrives from behind the head 122 the sound pressure bends the ear in the opposite direction.

Regardless of whether the sound wave arrives from in front of the head 122 or from behind the head 122, the second Kynar microphone 28 at location (b) responds very much the same because the surrounding tissues compress the same regardless of sound direction. Conversely, the first Kynar microphone 28 at location (a) or (a') produces an electrical signal that also includes bending of the lobule 13*a*. Note that implanting the first microphone 28 either at location (a) or (a') reverses the polarity of the signal due to the direction of lobe bending.

Thus by selecting an appropriate polarity for the signal produced by the microphone 28 implanted at location (a) or (a'), the signal-processing amplifier 30 can sum the signal from the two microphones 28 for sound coming from in front of the head 122, while canceling sound coming from behind the head 122. Such an operating mode may be highly desirable during conversation to eliminate at least part of the background noise. To implement this noise cancellation technique, the Kynar microphone 28 must be positioned on the lobule 13*a* of the external ear 13 so it responds differently to sound waves arriving from in front of the head 122 or from behind the malleus 22. Since the directivity of this second noise cancellation technique results from bending the Kynar microphone 28, the microphone 28 must therefore be implanted so the (a—a} axis gets stretched or compressed significantly by the bending of the lobule 13*a*. Conversely, the Kynar microphone 28 should be oriented to minimize bending along the axis (b—b).

As is readily apparent, the subject 12 may further enhance this noise cancellation by turning the head 122 to position the external ear 13 for optimum reception of sounds of interest, i.e. to enhance the discrimination between the two signals. The subtraction of the signals must be done carefully, or, for example, be restricted to one ear. If the subject 12 surrounded on all sides by noise reverberating from multiple surfaces, this second noise cancellation technique could provide almost complete cancellation of the sound. Under such circumstances, the subject 12 would be unaware of the ambient sound level, which, in some cases, may be hazardous. Consequently, it may be desirable to make noise cancellation using this second technique an optional feature at the control of the subject 12. For example, under some circumstances the subject 12 may want either to remove the subtraction of the signal of the second microphone 28, or reverse the polarity of the signal received from the first microphone 28.

Implantation of the microphone 28 insignificantly affects the phase relationship of signals received by the Kynar microphone 28. Accordingly an advantage of this second technique is that the subject 12 can first be custom outfitted with several sample microphones 28 placed in different locations on the surface of the lobule 13*a* while trying various different signal processing strategies with the signal-processing amplifier 30 before implanting the first microphone 28.

Figure 10:
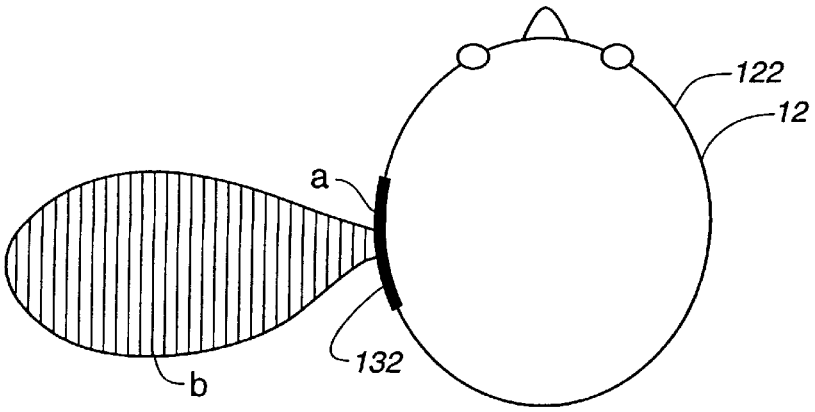
FIG. 10 is a plan view illustrating the microphone array depicted in FIG. 9 implanted on the skull of a subject to provide directional hearing sensitivity.

FIGS. 9 and 10 illustrate a third way of implementing the function of noise cancellation in which an elongated strip of Kynar can provide a distributed microphone. Each location at which a bio-compatible metallic electrode overlays the Kynar sheet 112 constitutes an active microphone 28. As illustrated in FIG. 9, the bio-compatible metallic electrodes applied to the sheet 112 may be easily patterned to form an array 132 of discrete separate microphones 28. An appropriately adapted signal-processing amplifier 30 then sums the signals from the microphones 28, applying appropriate weighing factors to the signal from each microphone 28, to obtain a desired characteristic sensitivity pattern from the array 132. In this way the hearing aid 10 can provide the subject 12 with directivity which the subject 12 may use to enhance the sounds of interest while concurrently reducing noise.

At 5000 Hz, the wavelength of sound in air is only 6.8 cm. Providing a directional array that is one-half wavelength long at 5000 Hz requires that the array 132 be only a few centimeters long. Output signals from each of the microphones 28 of the array 132 are then coupled through the miniature cable 33 to the signal-processing amplifier 30. The signal-processing amplifier 30 appropriately weighs the output signals from each of the microphones 28 with a cosine distribution to obtain the pattern c depicted in FIG. 9 over the length of the array 132. Implanting the array 132 on the head 122 of the subject 12 around the external ear 13 as depicted in FIG. 9 provides a directional sound receiving pattern as illustrated by a radiation pattern b depicted in FIG. 9. By directing the maximum sensitivity of the array 132 toward sounds of interest, it is readily apparent that the subject 12 may use the radiation pattern b to advantage to improve reception of such sounds, and to reject noise. As an alternative to the array 132 of microphones 28 described thus far, more complex super radiant array structures may be employed in the hearing aid 10.

In principle, two or more Kynar microphones 28 implanted on the subject 12 may be used advantageously to provide noise cancellation and/or microphone directivity. Any of the preceding microphone implantation techniques can be used with frequency filtration techniques to further enhance sound perceived by the subject 12. While the preferred embodiment of the invention uses Kynar microphones 28, in principle two or more suitable implantable microfabricated microphones may be used in implementing any of the techniques described above. However, the Kynar microphones 28 are preferred because they are extremely small, thin, unobtrusive and rugged, readily patterned into arrays as described, and are low cost.

As described above, there exist other applications for the microactuator 32, 32" and 32'" such as in implantable pumps, valves, or for other types of battery energized biological stimulation. The PCT Patent Application describes how signals, perhaps at ultrasonic frequencies, can be used to provide volume or frequency response control for the implantable hearing aid 10. This control technique can be readily generalized for use with other implantable microactuators 32 where it is desirable to change operating parameters after implantation. After implantation, very often it may be advantageous to change the stroke, or the stroke frequency or period of the microactuator 32, 32" or 32'". Using a Kynar microphone 28 as an acoustic pick up provides a very inexpensive method for effecting such control.

FIG. 11 schematically illustrates a typical arrangement of the microactuator 32, 32 or 32'", e.g. a pump, valve etc., implanted within a body 142, or a body limb, of the subject 12. Typically, a biologically inert or biocompatible housing 144 hermetically encloses the microactuator 32, 32" or 32'" together with a battery and control electronics 146. An external ultrasonic or acoustic transmitter 148 touches the body 142, possibly with fluid or grease coupling between the transmitter 148 and the skin. The transmitter 148 sends out a sequence of ultrasonic or acoustic pulses, indicated by wavy lines 152 in FIG. 12, which may be preprogrammed in electronics included within the transmitter 148. A receiving transducer 154, located within the housing 144 as depicted in FIG. 12, receives the sequence of pulses. An electronic circuit or microprocessor computer program included in the battery and control electronics 146 interprets the sequence of pulses as a command string to change the setting of the microactuator 32, 32" or 32'".

As illustrated in the enlarged schematic view of microactuator 32, 32" or 32'" and housing 144 depicted in FIG. 12, the receiving transducer 154, preferably consisting of a Kynar strip, is attached to a wall 156 of the housing 144. Ultrasonic pulses impinging upon the wall 156 deform and stress the Kynar receiving transducer 154 thereby generating electrical signals. After suitable amplification and processing, these electrical signals represent digital commands for controlling the operation of the microactuator 32, 32", or 32'".

FIGS. 13A and 13B illustrate a shape for the Kynar receiving transducer 154 adapted for attachment to a circularly-shaped wall 156 of the housing 144. Both sides of the Kynar sheet, which is typically between 8 to 50 microns thick, are overcoated with thin metal electrodes 158*a* and 158*b*. The overlapping area of the metal electrodes 158*a* and 158*b* defines an active area of the Kynar receiving transducer 154. The metal electrodes 158*a* and 158*b* may be fabricated from biocompatible materials such as gold, platinum, titanium etc. that are applied by vacuum deposition, sputtering, plating, or silk screening. If necessary, the metal electrodes 158*a* and 158*b* may be supported on the PVDF sheet by an underlying thin layer of an adhesive material such as nickel or chromium. Since Kynar is very inert, in principle the receiving transducer 154 having biocompatible electrodes may be used even on the outside of the housing 144.

Control data may be transferred from the transmitter 148 to the battery and control electronics 146 in modem like fashion using, for example, frequency shift keying in which one frequency is recognized as a one, while a different frequency is recognized as a zero. The carrier frequency of pulses transmitted by the transmitter 148 should preferably be above audio frequencies, in the ultrasonic range of 25 kHz to 45 MHz, and can be tailored to the particular depth or location of the implanted microactuator 32, 32" or 32'" to avoid echoes in the body. The higher the carrier frequency, the better the directivity of the transmitter 148, but the detecting electronics will then need to run at a higher clock frequency which increases the power dissipation. In this way a series of control pulses may be sent to the electronics within the housing 144, which the electronics interprets to alter the present operating mode for the microactuator 32, 32" or 32'", e.g. shutdown or activation, change the stroke or periodicity of the actuator (e.g. by changing the drive voltage accordingly, or by changing the period of the stroke etc.). The threshold for control pulse detection may be very high since normal sound waves in air bounce off body 142 without transmission. Only if the sound or ultrasound is effectively coupled into the body 142 by contact between the body 142 and the transmitter 148 having a well matched ultrasonic transducer will the receiving transducer 154 receive the pulses. This method for controlling operation of the microactuator 32, 32" or 32'", therefore, is quite immune to spurious commands or noise which is very desirable for life critical, implantable devices.

In principle the piezoelectric disk-shaped transducer 54, 54" or 54'" included in the microactuator 32, 32" or 32'" could also serve as the receiving transducer 154 at least in the lower ultrasonic range. However, then the control pulse receiving circuitry needs to be strongly decoupled from the transducer driving circuitry, that may supply high voltage driving electric signals to the transducer 54, 54" or 54'". Therefore, a separate inexpensive and rugged transducer such as the Kynar receiving transducer 154 is generally preferred.

As depicted in FIGS. 11 and 12, a photo-voltaic cell 162 may also be implanted subdermally and connected by a miniature cable or flexible printed circuit 164 to the battery and control electronics 146 located within the housing 144. In the embodiment depicted in FIG. 12, the photo-voltaic cell 162 is fastened to the housing 144, thereby preferably establishing one of the two electrical connections to the photo-voltaic cell 162. Accordingly, in the embodiment depicted in FIG. 12, the miniature cable or flexible printed circuit 164 need only include a single electrical conductor. The photo-voltaic cell 162 can be fabricated using amorphous silicon which permits forming the photo-voltaic cell 162 on various different substrates such as the housing 144, and even on a flexible substrate. If desirable for reasons of appearance, the photo-voltaic cell 162 may be suitably overcoated so that after implantation its presence beneath the skin is not readily observable. Located immediately beneath the skin, sufficient ambient light, indicated in FIG. 11 by a Z-shaped arrow 166, impinges upon the photo-voltaic cell 162 that electrical power produced by the photo-voltaic cell 162 is sufficient for energizing the operation of the microactuator 32, 32" or 32'". As illustrated in FIG. 1, the hearing aid 10 may also include a subdermally implanted photo-voltaic cell 172 that is coupled by a miniature cable or flexible printed circuit 174 to the signal-processing amplifier 30. In the embodiment depicted in FIG. 1, the photo-voltaic cell 172 supplies energy for operating the hearing aid 10.

IV Directional Booster

Figure 14:
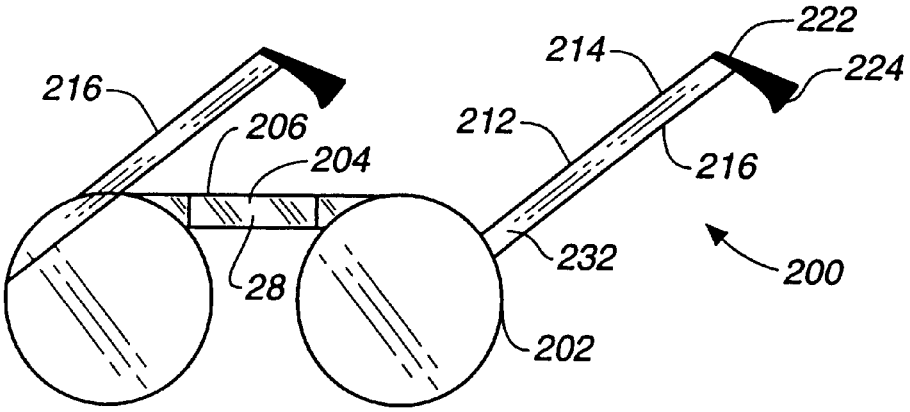
FIG. 14 is a perspective view of a directional booster that a subject, having an implanted hearing aid system, may wear for increasing directivity of sound perceived by the subject.
Figure 15:
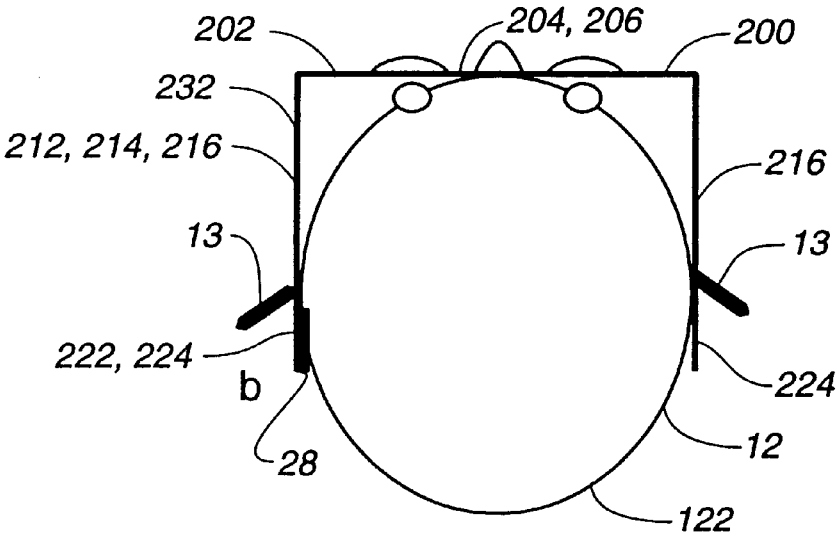
FIG. 15 is a plan view illustrating the directional booster depicted in FIG. 14 disposed externally on a subject's head.

Referring now to FIGS. 14 and 15, depicted there is a directional booster, referred to in FIG. 14 by the general reference character 200, that the subject 12 may wear on their head 122 for increasing directivity of sound perceived by the subject 12. In the illustrations of FIGS. 14 and 15, directional booster 200 is depicted as being incorporated into eyeglasses 202. While the eyeglasses 202 may be suitable appliance for supporting the directional booster 200 on the head 122 of the subject 12, other appliances such as a cap, hat or helmet may also be used for that same purpose.

In the illustrations of FIGS. 14 and 15, the directional booster 200 includes an array 204 of microphones 28 fastened to a bridge 206 of the eyeglasses 202. Similar to the array 132 depicted in FIGS. 9 and 10, each microphone 28 included in the array 204 independently generates an electrical signal in response to sound waves impinging upon the subject 12. The array 204 may be fabricated from Kynar in the same manner as the array 132, or may be a microfabricated microphone. A battery 212 for energizing operation of the directional booster 200 and a signal processing circuit 214 are embedded within or fastened to one of a pair of skull temples 216 included in the eyeglasses 202. Similar to the array 132 depicted in FIGS. 9 and 10, the signal processing circuit 214 sums the signals from the microphones 28 of the array 204, applying appropriate weighing factors to the signal from each microphone 28, to obtain a desired characteristic sensitivity pattern from the array 204 similar to that depicted in FIG. 10. The signal processing circuit 214 includes controls similar to those used in conventional hearing aids such as a volume control, etc. The signal processing circuit 214 supplies the processed electrical signal obtained in this way as an excitation signal to a booster transducer 222 carried in or fastened to an end piece 224 of the skull temple 216. The booster transducer 222 may be a piezoelectric transducer similar to the transducer 54, 54" or 54'" respectively included in the microactuator 32, 32" or 32'", the plates 68 included in the microactuator 32', or a ceramic speaker such as those used in some cellular telephones. Alternatively, the booster transducer 222 may be an electromagnetic transducer, a speaker such as those used in conventional hearing aids, or any other type of transducer that converts an electrical signal into mechanical vibrations.

Responsive to the excitation signal received from the signal processing circuit 214, the booster transducer 222 generates mechanical vibrations. The end piece 224 of the eyeglasses 202 urges the booster transducer 222 into intimate contact with the head 122 of the subject 12 whereby the vibrations, generated by the booster transducer 222, are coupled to the head 122. If, as illustrated in FIG. 15, the end piece 224 urges the booster transducer 222 into intimate contact with the head 122 at a location immediately adjacent to or over the microphone 28 included in the hearing aid 10, then the vibrations produced by the booster transducer 222 are coupled directly into the microphone 28. If the microphone 28 is implanted subdermally elsewhere on the head 122, then vibrations of the booster transducer 222 included in the directional booster 200 will be coupled into bone within the head 122 that carries such vibrations to the microphone 28 wherever it is located on the head 122. In this way, the directional booster 200 provides the subject 12 with directivity which the subject 12 may use to enhance the sounds of interest. In comparison with the 132 illustrated in FIG. 10, the directional booster 200 preferably exhibits greatest sensitivity directly in front of the subject 12. Accordingly, if the subject 12 wears the directional booster 200 on a social occasion the direction of greatest sensitivity is toward whoever the subject faces rather than at a right angle to such an individual.

While the array 204, the battery 212, the signal processing circuit 214 and the booster transducer 222 are all preferably supported on the head 122 of the subject 12 by an appliance such as the eyeglasses 202, a cap, hat, or helmet; in principle the battery 212 and the signal processing circuit 214, or the entire directional booster 200, could be located anywhere else on the subject 12. Similar to the photo-voltaic cell 162 depicted in FIGS. 11 and 12, and to the photo-voltaic cell 172 depicted in FIG. 1; a photo-voltaic cell 232, coupled to the signal processing circuit 214 and preferably located in the skull temple 216, may be included in the directional booster 200 to supply electrical energy for its operation.

The arrangements for the microactuator 32" or 32'", respectively depicted in FIGS. 4 and 5, may greatly extend the range of the actuator stroke which is often very desirable. The impedance matching characteristic is particularly suitable for piezoelectric transducer 54" and 54'", because these units have such a large force as compared to other piezoelectric devices providing the same displacement. Because of the very large forces developed, particularly with stress-biased PLZT structures, the force at the bellows diaphragm 82 or surface 96, which is decreased in the same way as the stroke is enlarged, can still be very large, in the order of tens of grams or higher. Such a mechanism may be used as a pump piston, with a one way valve, as a valve controlling mechanism or in a variety of other ways. The fluidic arrangement also spreads out the load over the surface of the transducer 54" and 54'", which is highly desirable as compared to point loading. This fluidic impedance matching arrangement can of course also be very advantageously used in other microactuators, which are not implanted.

The arrangements of FIGS. 2, 4 and 5 also provide for isolation of non-biocompatible parts of the microactuator 32, 32" and 32'". If no impedance matching is required, then arrangements of the transducer 54 depicted in the PCT Patent Application may be used. In one such arrangement, the disk-shaped piezoelectric transducer is conductively attached to a very thin bio-compatible metal diaphragm, which is hermetically sealed to can 4 by e-beam or laser beam welding. The thin diaphragm allows for the full deflection of the piezoelectric transducer with the edge of the diaphragm functioning as a hinge. In another arrangement described in the PCT Patent Application, a pair of piezoelectric transducers are juxtaposed and urged into contact with the diaphragm by sleeve which might also function as an electrical lead. As explained in the PCT Patent Application, juxtaposition of two piezoelectric transducers doubles the displacement for the same voltage applied across the pair of transducers. Accordingly, a second piezoelectric transducer, that is backed by a suitable support structure such as those disclosed in the PCT Patent Application, can be added to each transducer 54, 54" or 54'" or plates 68 to double their respective displacement(s).

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. In a hearing aid system that is adapted for implantation into a subject whose body has a head that includes a bony otic capsule which encloses a fluid-filled inner ear; the hearing aid system including:

a battery for energizing operation of said hearing aid system, said battery being adapted for implantation in the subject; and a microactuator also adapted for implantation in the subject in a location from which a transducer included in said microactuator may mechanically generate vibrations in the fluid within the inner ear of the subject, the microactuator receiving an electrical driving signal and producing vibrations in the fluid within the inner ear responsive to the received electrical driving signal;

wherein the improvement comprises a noise cancelling sound acquisition sub-system that includes:

at least two microphones both of which are adapted for subcutaneous implantation in the subject, and for independently generating an electrical signal in response to impingement of sound waves upon the subject; and signal processing means adapted for implantation in the subject, said signal processing means also being adapted for receiving both electrical signals produced by said microphones, for appropriately processing the received electrical signal to reduce noise present in the received electrical signal, and for re-transmitting the processed electrical signal to said microactuator for supplying the electrical driving signal thereto.

2. The improved hearing aid system of claim 1 wherein said microphones are adapted for implantation at separate locations on the subject.

3. The improved hearing aid system of claim 2 wherein at least one of said microphones is adapted for subcutaneous implantation in an earlobe of the subject.

4. The improved hearing aid system of claim 1 wherein said microphones are included in an array of microphones, each microphone included in said array of microphones, in response to impingement of sound waves upon the subject, independently generating an electrical signal that is received by said signal processing means which combines the signals received from the array of microphones to produce a desired received sound sensitivity pattern for the hearing aid system.

5. The improved hearing aid system of claim 4 wherein the array of microphones includes an elongated strip of polyvinylidene-flouride ("PVDF") having a plurality of biocompatible metallic electrodes formed thereon, each biocompatible metallic electrode providing one microphone of said array of microphones.

6. The improved hearing aid system of claim 4 wherein said signal processing means applies a weighted distribution in combining the electrical signals from said microphones included in said array of microphones.

7. The improved hearing aid system of claim 1 further comprising a photo-voltaic cell adapted for implantation within the subject, and for coupling to said signal processing means for supplying electrical energy for energizing operation of the hearing aid system.

8. The improved hearing aid system of claim 1 wherein the improvement also further comprises an improved microactuator that includes:

a hollow body having an open first end and an open first face that is separated from the first end;

a first flexible diaphragm sealed across the first end of said body, and adapted for deflecting outward from and inward toward the body, and for contacting the fluid within the inner ear;

a second flexible diaphragm sealed across the first face of said body thereby hermetically sealing said body;

an incompressible liquid filling said hermetically sealed body; and a first plate of a piezoelectric material that is mechanically coupled to said second flexible diaphragm and that is adapted for receiving the electrical driving signal, whereby upon application of the processed electrical signal to said first plate as the electrical driving signal, said first plate indirectly deflects said first flexible diaphragm by directly deflecting said second flexible diaphragm, which deflection is coupled by said liquid within the body from said second flexible diaphragm to said first flexible diaphragm.

9. The microactuator of claim 8 wherein said body further includes an open second face that is also separated from the first end of said body, the microactuator further comprising:

a third flexible diaphragm sealed across the second face of said body thereby hermetically sealing said body, said third flexible diaphragm; and a second plate of a piezoelectric material that is mechanically coupled to said third flexible diaphragm and that is adapted for receiving the electrical driving signal, whereby upon application of the processed electrical signal to said first and second plates as the electrical driving signals, said first and second plates indirectly deflect said first flexible diaphragm by directly deflecting said second flexible diaphragm and said third flexible diaphragm, which deflections are coupled by said liquid within the body from said second flexible diaphragm and said third flexible diaphragm to said first flexible diaphragm.

10. The microactuator of claim 9 wherein said second flexible diaphragm and said third flexible diaphragm have a combined cross-sectional area that is larger than a cross-sectional area of the first flexible diaphragm.

11. The microactuator of claim 9 wherein said second flexible diaphragm and said third flexible diaphragm are oriented in a direction that is not substantially parallel to the first flexible diaphragm.

12. The microactuator of claim 11 wherein said second flexible diaphragm and said third flexible diaphragm are oriented substantially perpendicular to said first flexible diaphragm.

13. The microactuator of claim 11 wherein said second flexible diaphragm is oriented substantially parallel to said third flexible diaphragm.

14. The improved hearing aid system of claim 8 wherein the improvement also further comprises a directional booster adapted to be worn externally on the subject's body, said directional booster comprising:

a battery for energizing operation of said directional booster;

an array of microphones, each microphone included in said array of microphones, in response to impingement of sound waves upon the subject, independently generating an electrical signal;

a booster transducer adapted for receiving an excitation signal and for mechanically generating vibrations in response to the received excitation signal;

an appliance for supporting both said array of microphones and said booster transducer on the subject's body, and for urging said booster transducer into intimate contact with the subject's body whereby vibrations generated by said booster transducer are coupled to at least one of said pair of microphones that are adapted for subcutaneous implantation in the subject; and a signal processing circuit which receives and combines the electrical signals generated by the array of microphones to produce a desired received sound sensitivity pattern in the excitation signal which said signal processing circuit supplies to said booster transducer.

15. The improved hearing aid system of claim 14 wherein said appliance is an eyeglasses frame.

16. The improved hearing aid system of claim 14 wherein said appliance further supports said battery and said signal processing circuit on the head of the subject.

17. An improved hearing aid system that is adapted for implantation into a subject having a fluid-filled inner ear that is enclosed by a bony otic capsule; the improved hearing aid system including:

a microphone adapted for subcutaneous implantation in the subject and for generating an electrical signal in response to impingement of sound waves upon the subject;

signal processing means adapted for receiving the electrical signal from the microphone, for processing the electrical signal, and for re-transmitting a processed electrical signal, said signal processing means also being adapted for implantation in the subject; and a battery for supplying electrical power to said signal processing means, said battery also being adapted for implantation in the subject;

wherein the improvement comprises a microactuator that includes:

a hollow body having an open first end, an open first face that is separated from the first end, an open second face that is also separated from the first end and from the first face;

a first flexible diaphragm sealed across the first end of said body, and adapted for deflecting outward from and inward toward the body, and for contacting the fluid within the inner ear;

second and third flexible diaphragms respectively sealed across the first and the second faces of said body thereby hermetically sealing said body; and first and second plates of piezoelectric material that are mechanically coupled respectively to said second and third flexible diaphragms and that are respectively adapted for receiving the processed electrical signal, whereby upon application of the processed electrical signal to said first and second plates, said first and second plates indirectly deflect said first flexible diaphragm by directly deflecting said second flexible diaphragm and said third flexible diaphragm, which deflections are coupled by said liquid within the body from said second flexible diaphragm and said third flexible diaphragm to said first flexible diaphragm.

18. The microactuator of claim 17, wherein said second flexible diaphragm and said third flexible diaphragm have a combined cross-sectional area that is larger than a cross-sectional area of the first flexible diaphragm.

19. The microactuator of claim 17, wherein said second flexible diaphragm and said third flexible diaphragm are oriented in a direction that is not substantially parallel to the first flexible diaphragm.

20. The microactuator of claim 19, wherein said second flexible diaphragm and said third flexible diaphragm are oriented substantially perpendicular to said first flexible diaphragm.

21. The microactuator of claim 17, wherein said second flexible diaphragm is oriented substantially parallel to said third flexible diaphragm.

22. An improved hearing aid system that is adapted for implantation into a subject having a fluid-filled inner ear that is enclosed by a bony otic capsule; the improved hearing aid system including:

a microphone adapted for subcutaneous implantation in the subject and for generating an electrical signal in response to impingement of sound waves upon the subject;

signal processing means adapted for receiving the electrical signal from the microphone, for processing the electrical signal, and for re-transmitting a processed electrical signal, said signal processing means also being adapted for implantation in the subject;

a battery for supplying electrical power to said signal processing means, said battery also being adapted for implantation in the subject; and a microactuator also adapted for implantation in the subject in a location from which a transducer included in said microactuator may mechanically generate vibrations in the fluid within the inner ear of the subject, the microactuator receiving the processed electrical signal from the signal processing means and producing vibrations in the fluid within the inner ear responsive to the received processed electrical signal;

wherein the improvement comprises:

a photo-voltaic cell adapted for implantation subdermally within the subject where ambient light impinges upon the photo-voltaic cell, and for coupling electrical power to said signal processing means, in conjunction with electrical power supplied by the battery, for energizing operation of the hearing aid system.

* * * * *